US007004675B2

(12) United States Patent
Wayne

(10) Patent No.: US 7,004,675 B2
(45) Date of Patent: Feb. 28, 2006

(54) PAVEMENT RECYCLING MACHINE AND METHOD OF RECYCLING PAVEMENT

(75) Inventor: Michael Lee Wayne, Davidson, NC (US)

(73) Assignee: Carolina P&P, LLC, Davidson, NC (US)

( * ) Notice: Subject to any disclaimer, the term of this patent is extended or adjusted under 35 U.S.C. 154(b) by 0 days.

(21) Appl. No.: 10/780,196

(22) Filed: Feb. 17, 2004

(65) Prior Publication Data

US 2004/0175234 A1 Sep. 9, 2004

Related U.S. Application Data

(60) Provisional application No. 60/452,408, filed on Mar. 6, 2003.

(51) Int. Cl.
*E01C 23/088* (2006.01)

(52) U.S. Cl. ..... 404/91; 404/90; 404/94; 299/39.6

(58) Field of Classification Search ..... 404/90, 404/91, 92, 93, 94; 299/39.1, 39.2, 39.6, 299/39.9

See application file for complete search history.

(56) References Cited

U.S. PATENT DOCUMENTS

| | | | | |
|---|---|---|---|---|
| 3,843,274 A | * | 10/1974 | Gutman et al. | 404/91 |
| 4,172,679 A | | 10/1979 | Wirtgen | |
| 4,226,552 A | | 10/1980 | Moench | |
| 4,261,669 A | | 4/1981 | Edo | |
| 4,780,022 A | * | 10/1988 | Ohiba et al. | 404/90 |
| 4,793,730 A | | 12/1988 | Butch | |
| 4,850,740 A | | 7/1989 | Wiley | |
| 4,929,120 A | | 5/1990 | Wiley et al. | |
| 4,946,307 A | * | 8/1990 | Jakob | 404/92 |
| 5,080,524 A | | 1/1992 | Lee | |
| 5,484,224 A | | 1/1996 | Lynch | |
| 5,791,814 A | | 8/1998 | Wiley | |
| 6,416,249 B1 | * | 7/2002 | Crupi | 404/91 |
| 6,439,804 B1 | * | 8/2002 | Crupi | 404/75 |
| 6,695,530 B1 | * | 2/2004 | Crupi | 404/91 |

FOREIGN PATENT DOCUMENTS

WO 90/10752 * 9/1990

* cited by examiner

*Primary Examiner*—Gary S. Hartmann
(74) *Attorney, Agent, or Firm*—Adams Evans, P.A.

(57) ABSTRACT

A pavement recycling assembly includes a frame defining a grinding chamber and a mixing chamber. The grinding chamber carries a rotatable laterally-extending toothed grinding drum and the mixing chamber houses at least one toothed rotatable mixing wheel. A screed assembly is disposed behind the mixing chamber for extruding said mixture at a desired height so as to form a pavement. Pavement is recycled in-situ using the recycling assembly by grinding existing pavement, adding fluid asphalt to the pavement, optionally adding supplemental pavement, and mixing the fluid asphalt with the existing and/or supplemental pavement. The mixture is then extruded at the proper height by an adjustable screed. The recycling assembly may be suspended under a self-propelled chassis so that it can be shifted laterally to engage a pavement surface selected for repair without moving the entire chassis.

6 Claims, 6 Drawing Sheets

PAVEMENT RECYCLING MACHINE AND METHOD OF RECYCLING PAVEMENT

This application claims the benefit of U.S. Provisional Application No. 60/452,408, filed Mar. 6, 2003.

BACKGROUND OF THE INVENTION

This invention relates generally to patching and recycling asphalt pavement and more particularly to an apparatus and method for recycling and patching asphalt pavement in-situ.

Asphalt pavement often requires replacement or repair, for example by patching. Pavement can be repaired with new material or recycled material, although it is considered desirable to use recycled material for cost and environmental reasons. Recycling typically involves breaking up and removing the old pavement and hauling it to a recycling plant. Then new or recycled material is hauled from a plant to the work site. Other pavement recycling approaches include portable or mobile recycling plants or various types of in-situ recycling equipment. These prior art approaches generally require large or complex equipment, and are not particularly suited for patching operations. Accordingly, there is a need for a compact and simple in-situ pavement recycling machine.

BRIEF SUMMARY OF THE INVENTION

Therefore, it is an object of the invention to provide a self-contained asphalt recycling assembly.

It is another object of the invention to provide a pavement recycling machine which is particularly suitable for patching portions of an asphalt pavement roadway.

It is another object of the invention to provide a pavement recycling machine having a recycling assembly which can be laterally shifted to engage a portion of a roadway without moving the entire machine.

These and other objects of the present invention are achieved in the preferred embodiments disclosed below by providing a pavement recycling assembly, including a frame having left and right side plates, a top plate, and an open bottom for contacting a pavement surface, the frame defining a mixing chamber and an opening in the top plate in communication with the mixing chamber, A flat anvil is disposed at a forward end of the frame for engaging the pavement surface. A laterally-extending toothed grinding drum is rotatably mounted in a grinding chamber in the frame behind the anvil and ahead of the mixing chamber for breaking up and grinding the pavement. Means are provided for rotating the grinding cylinder and for introducing fluid asphalt into the frame At least one laterally-extending toothed rotatable mixing wheel is disposed in the mixing chamber for forming a mixture of the fluid asphalt and the ground pavement, along with means for rotating the mixing wheel. A screed assembly is disposed behind the mixing chamber for extruding the mixture at a desired height so as to form a pavement.

According to another embodiment of the invention the means for introducing fluid asphalt comprises at least one row of spray nozzles.

According to another embodiment of the invention the row of spray nozzles is disposed above the opening.

According to another embodiment of the invention first and second laterally-extending toothed rotatable mixing wheels are disposed in the mixing chamber.

According to another embodiment of the invention the vertical position of the grinding drum is adjustable relative to the frame to change the depth of cut of the grinding drum.

According to another embodiment of the invention the anvil is movable longitudinally relative to the frame.

According to another embodiment of the invention the anvil is coupled to the grinding cylinder such that the anvil moves rearward as the grinding drum is moved upward and the anvil moves downward as the grinding drum is moved downward.

According to another embodiment of the invention a heater is disposed in the frame behind the grinding drum from heating the ground pavement.

According to another embodiment of the invention a vertically adjustable material control gate is disposed in the frame behind the mixing chamber for controlling the amount of material flowing into the screed assembly.

According to another embodiment of the invention, a pavement recycling machine includes a wheeled chassis. A pavement recycling assembly is suspended under the chassis, the chassis being selectively movable vertically and laterally relative to the chassis. The recycling assembly includes a frame having left and right side plates, a top plate, and an open bottom for contacting a pavement surface, the frame defining a mixing chamber and an opening in the top plate in communication with the mixing chamber a toothed grinding cylinder rotatably mounted in a grinding chamber in the frame ahead of the mixing chamber for breaking up and grinding the pavement; means for rotating the grinding cylinder; at least one spray nozzle for introducing fluid asphalt binder into the frame; at least one toothed rotatable mixing wheel disposed in the mixing chamber for forming a mixture of the fluid asphalt binder and the ground pavement; means for rotating the mixing wheel; and a screed assembly disposed behind the mixing chamber for extruding the mixture at a desired height.

According to another embodiment of the invention, the recycling machine includes a feed hopper for receiving supplemental pavement, and a conveyor from moving the supplemental pavement from the feed hopper to the opening of the mixing chamber.

According to another embodiment of the invention, the recycling machine includes a feed hopper for receiving supplemental pavement, and a conveyor from moving the supplemental pavement from the feed hopper to the opening of the mixing chamber.

According to another embodiment of the invention, an in-situ method of recycling asphaltic pavement includes providing a pavement recycling assembly which has a frame having left and right side plates, a top plate, and an open bottom for contacting a pavement surface, the frame defining a mixing chamber and an opening in the top plate in communication with the mixing chamber; a toothed grinding cylinder rotatably mounted in a grinding chamber in the frame ahead of the mixing chamber for breaking up and grinding the pavement; means for rotating the grinding cylinder; at least one spray nozzle for introducing fluid asphalt binder into the frame; at least one toothed rotatable mixing wheel disposed in the mixing chamber for forming a mixture of the fluid asphalt binder and the ground pavement; means for rotating the mixing wheel; and a screed assembly disposed behind the mixing chamber for extruding the mixture at a desired height.

A selected area of asphaltic pavement is broken up and ground using the grinding drum. Fluid asphalt is introduced to the ground pavement. A mixture is creating of the fluid asphalt and the ground pavement using the mixing wheels. The mixture is extruded through the screed to create a pavement.

According to another embodiment of the invention, the method of recycling asphaltic pavement further includes suspending the pavement recycling assembly under a chassis so that it is laterally movable relative to the chassis; and selectively moving the pavement recycling assembly laterally left or right relative to the chassis so that the recycling assembly is aligned with a pavement surface to be recycled According to another embodiment of the invention, the method of recycling asphaltic pavement further includes providing a hopper mounted to the chassis for receiving supplemental asphaltic pavement; and introducing supplemental pavement from the hopper into the mixing chamber along with the ground pavement and the fluid asphalt.

According to another embodiment of the invention, the method of recycling asphaltic pavement further includes providing a hopper mounted to the chassis for receiving supplemental asphaltic pavement; and introducing supplemental pavement from the hopper into the grinding chamber.

According to another embodiment of the invention, the method of recycling asphaltic pavement further includes selectively limiting the quantity of asphalt which passes from the mixing chamber to the screed assembly.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
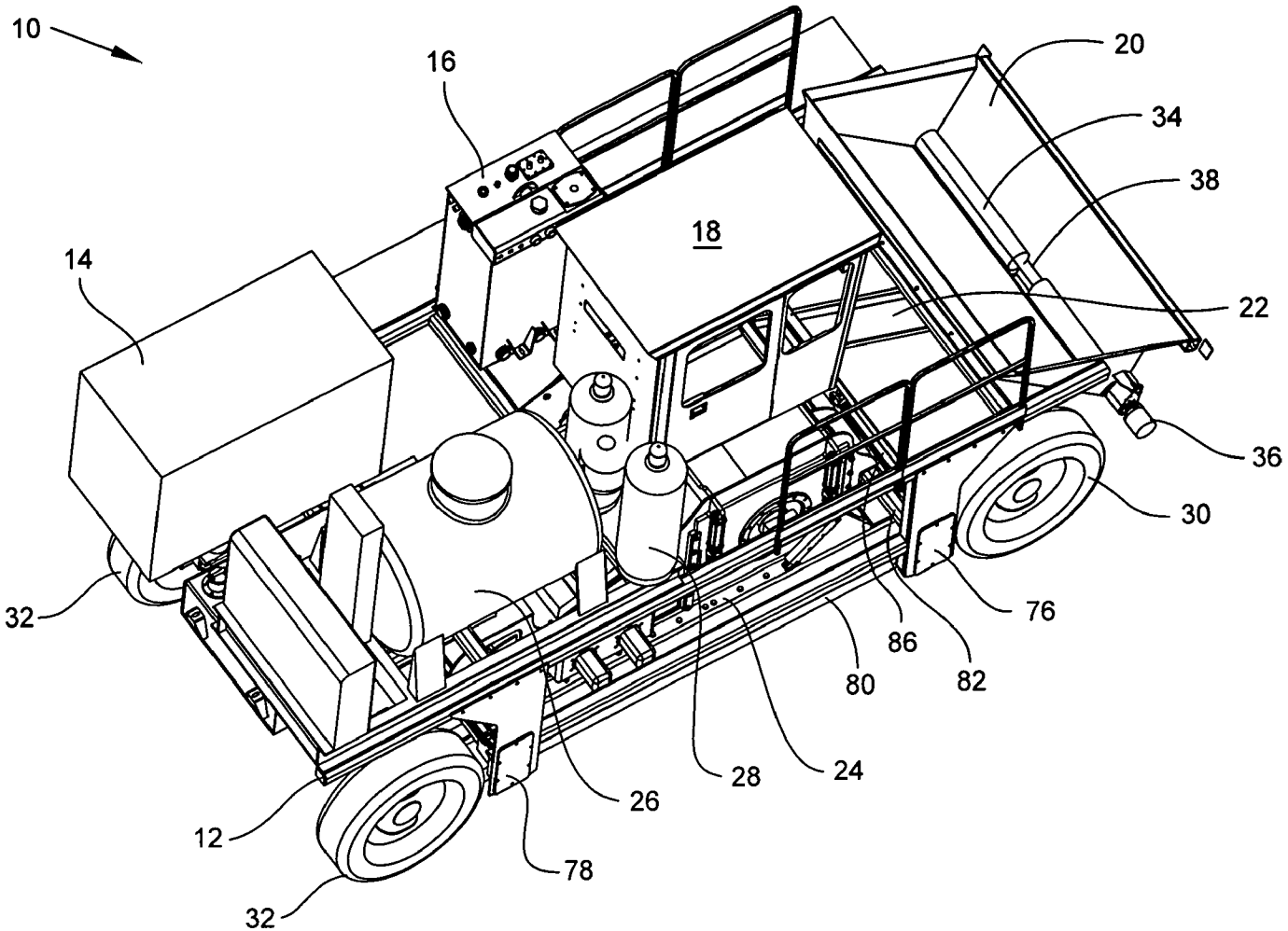
FIG. 1 is a perspective view of a pavement recycling machine constructed in accordance with the present invention.
Figure 2:
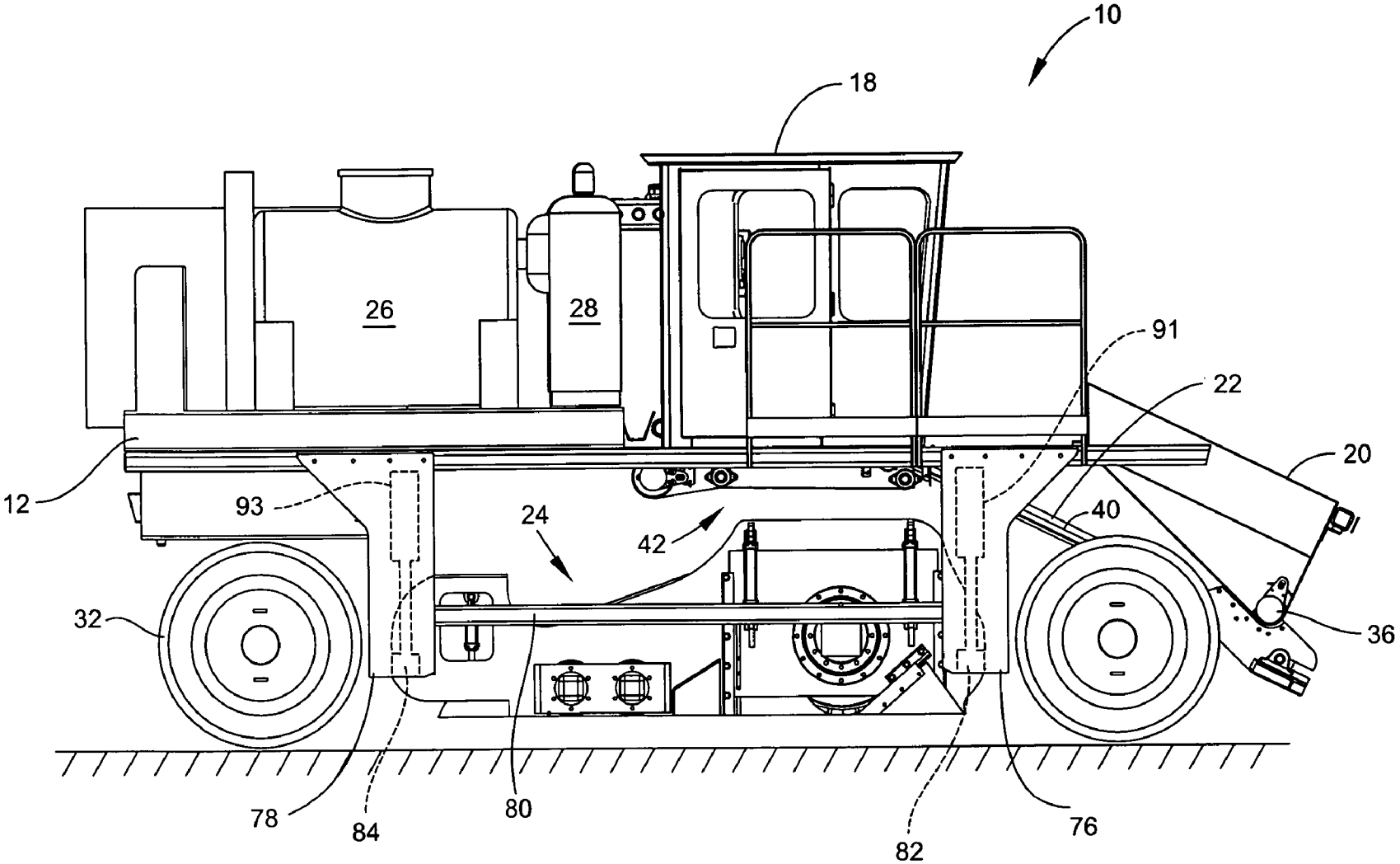
FIG. 2 is a side elevational view of the pavement recycling machine of in FIG. 1.

Referring to the drawings wherein identical reference numerals denote the same elements throughout the various views, FIGS. 1 and 2 illustrate the general layout of an exemplary asphalt pavement recycling machine 10. As used herein, the terms "asphalt" or "asphalt binder" refer to an asphaltic binder, while the term "pavement" refers to a mixture of asphaltic binder and an aggregate. It is noted that the term "asphalt" is sometimes used by those skilled in the art interchangeably to refer to either an asphaltic binder alone or to the finished pavement. The recycling machine 10 has a wheeled chassis 12 which carries a power plant 14 of a known type such as a Diesel engine, a hydraulic fluid reservoir 16, cab 18 with operator controls, a feed hopper 20, and a conveyor 22. A pavement recycling assembly 24 is suspended under the chassis 12. The chassis 12 also carries an asphalt binder tank 26 for carrying fluid asphaltic binder, and heating fuel tanks 28 for carrying propane or a similar fuel. In the particular example illustrated, the chassis 12 is carried on a steerable pair of front wheels 30 and a steerable pair of rear wheels 32. One or more of the wheels may be driven by any known means. For example, a known type of hydraulic drive may be used in which the power plant 14 drives a pump (not shown) which supplies a flow of pressurized hydraulic fluid through a system of control valves and conduits to one or more hydraulic motors (also not shown), to drive the wheels 30 and 32. Similar pumps, piping, and valves may be used to drive other hydraulic components described below. Seating and controls for the machine operator of a known type are provided in the cab18. The feed hopper 20 receives paving material (i.e. new or recycled asphalt pavement) to be fed to the recycling assembly 24. The feed hopper 20 is carried at the forward end of the recycling machine 10 so that it may be supplied from a dump truck which proceeds ahead of the recycling machine 10. The feed hopper 20 includes a screw feeder 34 driven by a hydraulic motor 36 which moves the paving material from the sides of the hopper 20 to a central outlet 38. The conveyor 22 receives material from the central outlet 38 and carries it to the recycling assembly 24. The conveyer 22 is mounted under the chassis 12 above the recycling assembly 24 and includes an inclined forward section 40 and a level aft section 42. In the illustrated example the conveyor is about 30.5 cm (12 in.) wide.

Figure 4:
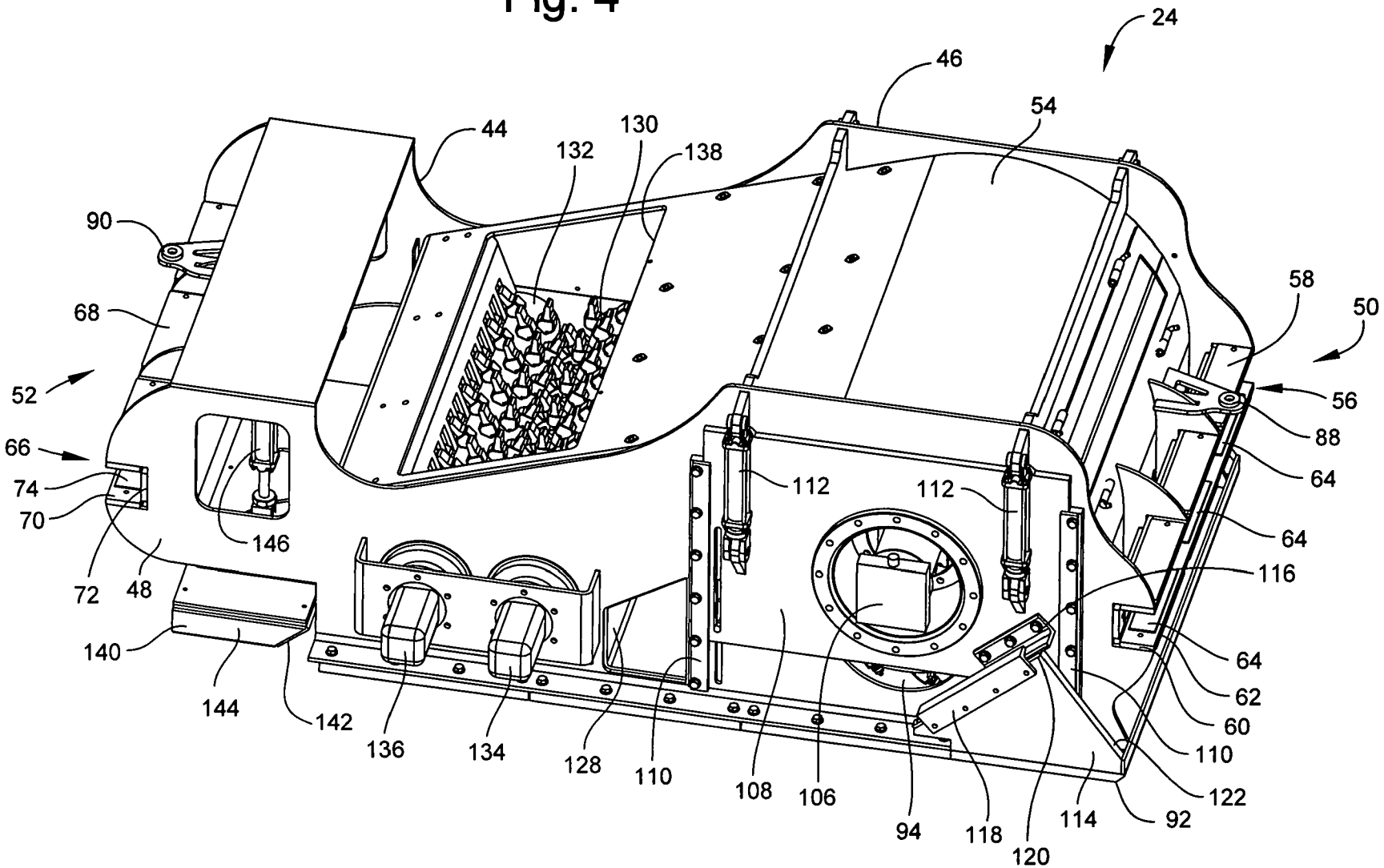
FIG. 4 is a perspective view of a recycling assembly.
Figure 5:
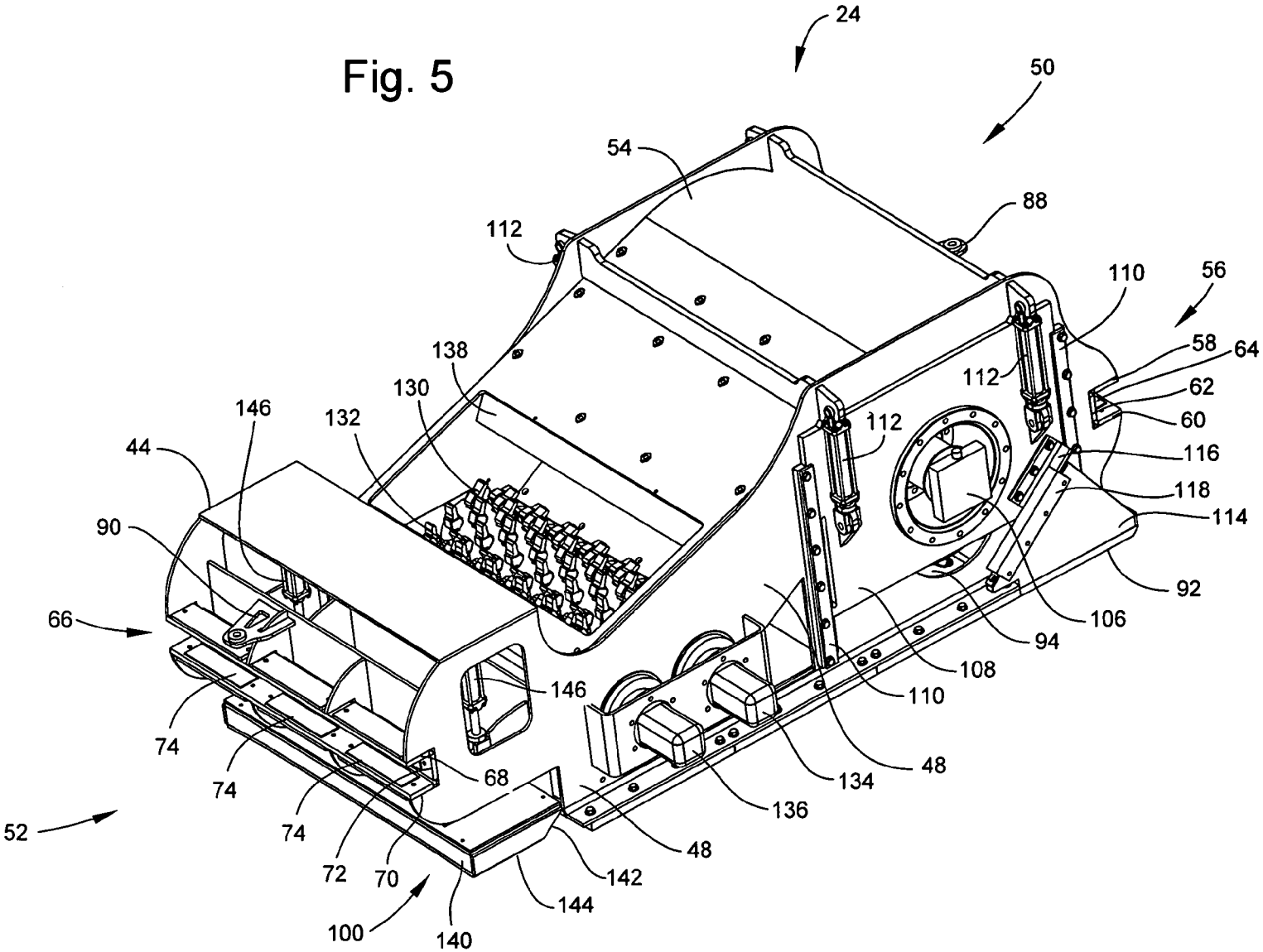
FIG. 5 is another perspective view of the recycling assembly of FIG. 4.

FIGS. 4 and 5 illustrate the recycling assembly 24 in detail. The recycling assembly 24 is carried on a frame 44, which is built up from steel plate or sheet. The frame 44 includes spaced-apart left and right sidewalls 46 and 48 that extend from the forward end 50 to the aft end 52 of the frame 44. A curved top panel 54 covers the internal components of the recycling assembly 24 and forms part of the flow path therethrough. The frame 44 could optionally be integrated with the chassis 12. The forward end of the frame 50 includes a forward mounting slot 56, which is defined by parallel, horizontally-oriented first and second bearing plates 58 and 60, and a vertically oriented third bearing plate 62 which are arranged to from a square-sided "C" channel. The bearing plates 58, 60, and 62 are constructed of heavy steel plate or an equivalent material, and may optionally include flat wear pads 64. The wear pads 64 reduce friction and may be made from oil-impregnated plastic of a known type, or a similar material.

The aft end of the frame 52 includes an aft mounting slot 66, which is defined by parallel, horizontally-oriented fourth and fifth bearing plates 68 and 70, and a vertically oriented sixth bearing plate 72 which are arranged to from a square-sided "C" channel. The bearing plates 68, 70, and 72 are constructed of heavy steel plate or an equivalent material, and may optionally include flat wear pads 74. The wear pads 74 reduce friction and may be made from oil-impregnated plastic of a known type, or a similar material.

Returning to FIG. 2, the chassis 12 includes two spaced-apart downward-extending front posts 76, and two spaced-apart downward extending rear posts 78. The front and rear posts 76 and 78 on each side are tied together by a longitudinally-extending side beam 80. A forward transverse rail 82 and an aft transverse rail 84 are suspended underneath the chassis 12. The forward transverse rail 82 is visible in FIG. 1 and both of the transverse rails 82 and 94 are shown in dashed lines in FIG. 2. The forward and aft transverse rails 82 and 84 are constructed of square-section steel tubes or a similar material. The forward transverse rail 82 extends between the pair of forward posts 76 and the aft transverse rail 84 extends between the pair of rear posts 78.

The frame 44 of the recycling assembly 24 is mounted to the chassis 12 by way of the forward and aft transverse rails 82 and 84. The forward transverse rail 82 is received in the forward mounting slot 56 of the frame 44, and the aft transverse rail 84 is received in the aft mounting slot 66. A forward traversing unit 86 is mounted on the forward traverse rail 82 (see FIG. 1) and connected to a forward pivot 88 of the frame 44. An aft traversing unit (not shown) is mounted on the aft traverse rail 84 and connected to an aft pivot 90 of the frame 44. Both the forward and aft traversing units may be a known type of hydraulic piston-cylinder unit. The forward and aft transverse rails 82 and 84 are mounted so they can move vertically relative to the front and rear posts 76 and 78. A pair of forward lift units 91 and a pair of rear lift units 93, which may be known hydraulic piston-cylinder assemblies, are connected to the chassis 12 and the transverse rails 82 and 84, so as to selectively move the transverse rails up or down. Thus mounted to the chassis 12 as described above, the entire recycling assembly 24 may be selectively raised or lowered and shifted laterally left or right relative to the chassis 12 of the recycling machine 10. This enables a section of pavement that is away from the center of a road lane to be repaired without having to steer the entire recycling machine 10 into an adjacent lane, which is useful in patching operations.

Figure 3:
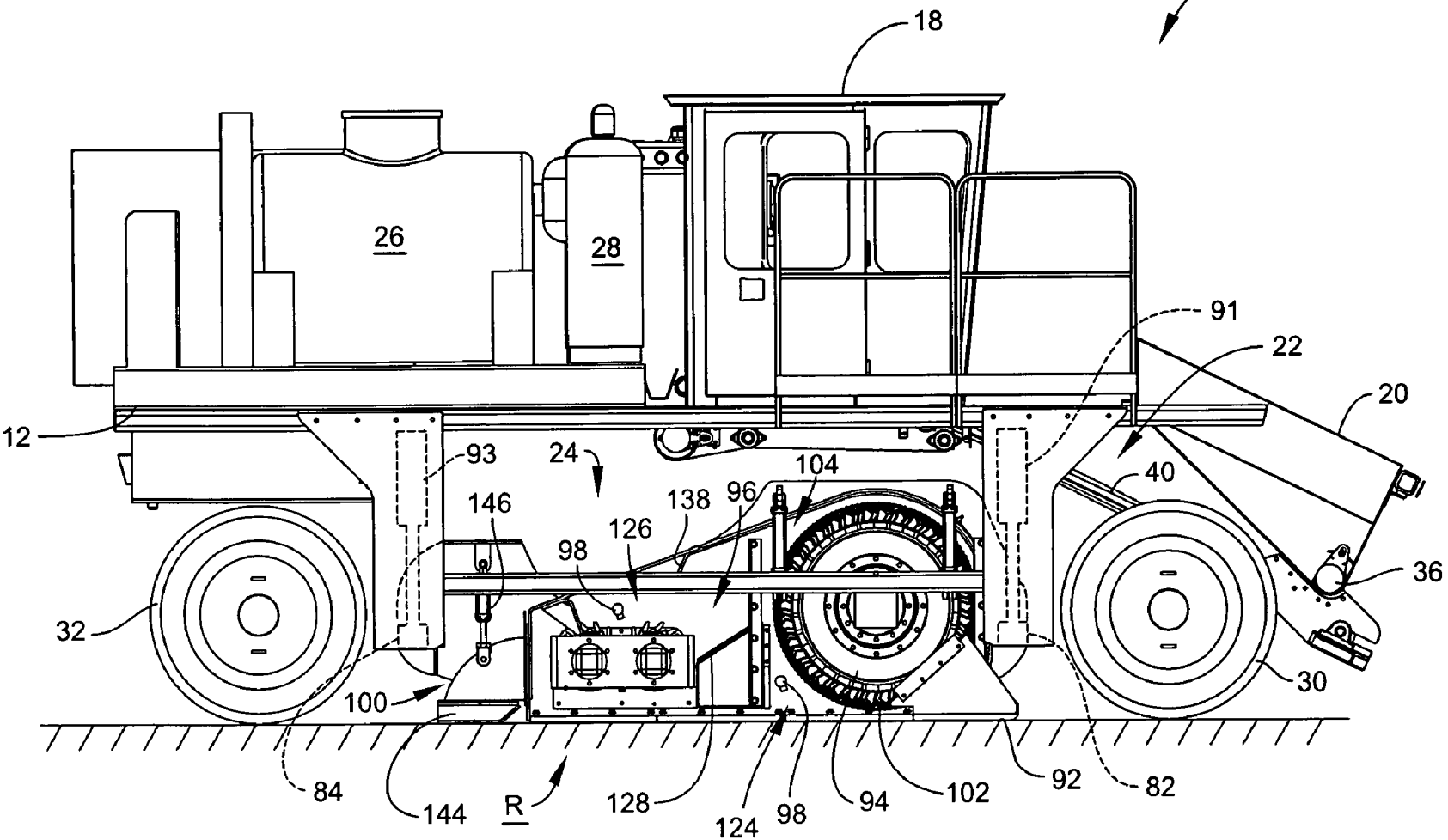
FIG. 3 is a partial sectional view of the pavement recycling machine of FIG. 2 showing the internal components of a recycling assembly.

Referring to FIGS. 3, 4, and 5, the basic components of the recycling assembly 24 comprise an anvil 92, a grinder drum 94, a mixing chamber 96, one or more arrays of spray nozzles 98, and a screed assembly 100.

The grinder drum 94 is a cylindrical assembly having a plurality of grinding teeth 102 disposed about its periphery. For a pavement patching application, the width of the grinder drum 94 (and thus the recycling assembly 24) would be about 0.9 m (36 in.) to about 1.2 m (48 in.). It is also possible to make the grinder drum 94 and recycling assembly 24 wide enough that an entire road lane may be recycled in one pass. The number and pattern of the teeth 102 is varied depending upon on the desired mesh size of the finished pavement. The grinder drum 94 is received in a grinding chamber 104 which is defined by the top plate 54 of the frame 44. The grinder drum 94 is rotated about its axis by a hydraulic motor 106 or other suitable means and is mounted to the frame 44 at each end by a flat drum plate 108 which is captured at its edges by vertical rails 110. The drum plates 108 are movable vertically relative to the frame 44 to adjust the grinding depth. In this example the drum plates 108 are moved by a plurality of hydraulic piston-cylinder assemblies 112. The grinder drum 94 is capable of removing the entire thickness of a layer of asphalt pavement, and the typical depth of cut may be from about 2.5 cm (1 in.) to about 15.2 cm (6 in.) depending upon the depth of damage present.

The anvil 92 is a thick, flat plate disposed at the front end 50 of the recycling assembly 24. The recycling assembly 24 rides on the anvil 92 thus providing a height reference for the grinding operation. The anvil 92 has an upstanding side plate 114 attached to each end thereof. Each of these side plates 114 is clamped to an L-bracket 116 by a retainer 118, and has front and rear inclined surfaces 120 and 122. Each of the L-brackets 116 is in turn attached to one of the drum plates 108 at an angle. When the grinding drum 94 is raised or lowered, the L-bracket 166 moves in the slot created by the retainer 118 and the rear inclined surface 120 of the side plate 114. This causes the anvil 92 to move forward when the grinding drum 94 is lowered and rearward when the grinding drum 94 is raised. This keeps the longitudinal distance between the grinding drum 94 and the anvil 92 approximately constant as the depth of cut is changed.

One or more arrays of spray nozzles 98 may be mounted at several locations in the recycling assembly 24. The number, spacing and positioning of the spray nozzles 98 may be varied to suit a particular application. In one arrangement, the spray nozzles 98 are disposed in transverse rows 124 and 126 each having four nozzles equally spaced across the width of the recycling assembly 24. The spray nozzles 98 are connected to the fluid asphalt binder tank 26 through appropriate pipes, pumps, and valves of fluid a known type (not shown), in order to allow selective discharge of the fluid asphalt binder through the spray nozzles 98.

The mixing chamber 96 is disposed behind the grinding drum 94. The mixing chamber 96 is defined by the side walls 46 and 48 of the frame 44, a baffle 128 disposed behind the grinding drum 94, and partially by the top plate 54. The bottom of the mixing chamber 38 is defined by the roadbed "R" below the recycling machine 10. The mixing chamber 96 receives laterally-extending toothed first and second mixing wheels 130 and 132, which are mounted for rotation in the frame 44 and driven by hydraulic motors 134 and 136. An opening 138 is formed through the top plate 54 over the mixing wheels 130 and 132 and serves to admit material from the conveyor 22 to the mixing chamber 96. The opening 138 is wide enough so that material from the centrally-positioned conveyor 22 will fall into the mixing chamber 96 no matter how far left or right the recycling assembly 24 is shifted.

The screed assembly 100 is disposed behind the mixing chamber 96. The screed assembly 100 includes a heated screed 140 of a known type having a rounded or angled nose 142 and a flat bottom 144. The height of the screed 140 (and thus the thickness of the pavement exiting the recycling machine 10) is controlled by a screed actuator 146 such as the illustrated hydraulic piston-cylinder assembly.

The operation of the recycling machine 10 will now be described with respect to FIG. 3. The recycling machine 10 is driven forward over an area of pavement to be patched. The recycling assembly 24 is shifted laterally to align with a specific pavement area as required. If necessary depending upon ambient conditions, the existing pavement is heated with a pre-heater (not shown) such as a steam box or a propane burner suspended ahead of the recycling assembly 24. The front end of the recycling assembly 24 rides on the anvil 92 thus providing a height reference. The grinder drum 94 is lowered to the appropriate depth and rotated, causing the teeth 102 to break up and grind the old pavement into small pieces. For purposes of illustrative clarity, the flow of old pavement, asphalt binder, and new asphalt is not shown in FIG. 3. Fluid asphalt may be added by the first row 124 of spray nozzles 98 positioned in the grinding chamber 104. The introduction of fluid asphalt cools and lubricates the grinding teeth 102 and also provides a portion of the asphalt binder needed to bring the mixture of old, ground pavement and new pavement to the required properties for re-application as finished pavement.

The mixture then enters the mixing chamber 96 where it is mixed by the mixing wheels 130 and 132. If needed, additional fluid asphalt may be added to the mixture from the second row 126 of spray nozzles 98. In a typical application, it is estimated that a quantity of asphalt binder equal to about 1.5% to about 2.0% by volume of the total mixture of new asphalt and recycled asphalt will result in a satisfactory finished pavement. By introducing the asphalt binder at several locations, lubrication is provided to the operating parts of the recycling assembly 24. Furthermore, a more consistent final pavement product is obtained if a portion of the total required amount of asphalt binder is added to the mixture in stages rather than at a single point in the recycling process. In many cases the recycling machine 10 will be used to repair potholes, drive wheel ruts, or other areas where portions of the original pavement are missing. Accordingly, supplemental pavement (typically new, but recycled material may be used) in the required amount is transported to the mixing chamber 96 from the feed hopper 20 by the conveyor 22, and enters the mixing chamber 96 through the opening 138.

As the recycling machine 10 continues to advance, the mixed pavement passes from the mixing chamber 96 to the screed assembly 100. The screed assembly 100 extrudes the material out at the desired height to form a finished pavement. The finished pavement may then be consolidated by a roller (not shown) in a known fashion.

Figure 6:
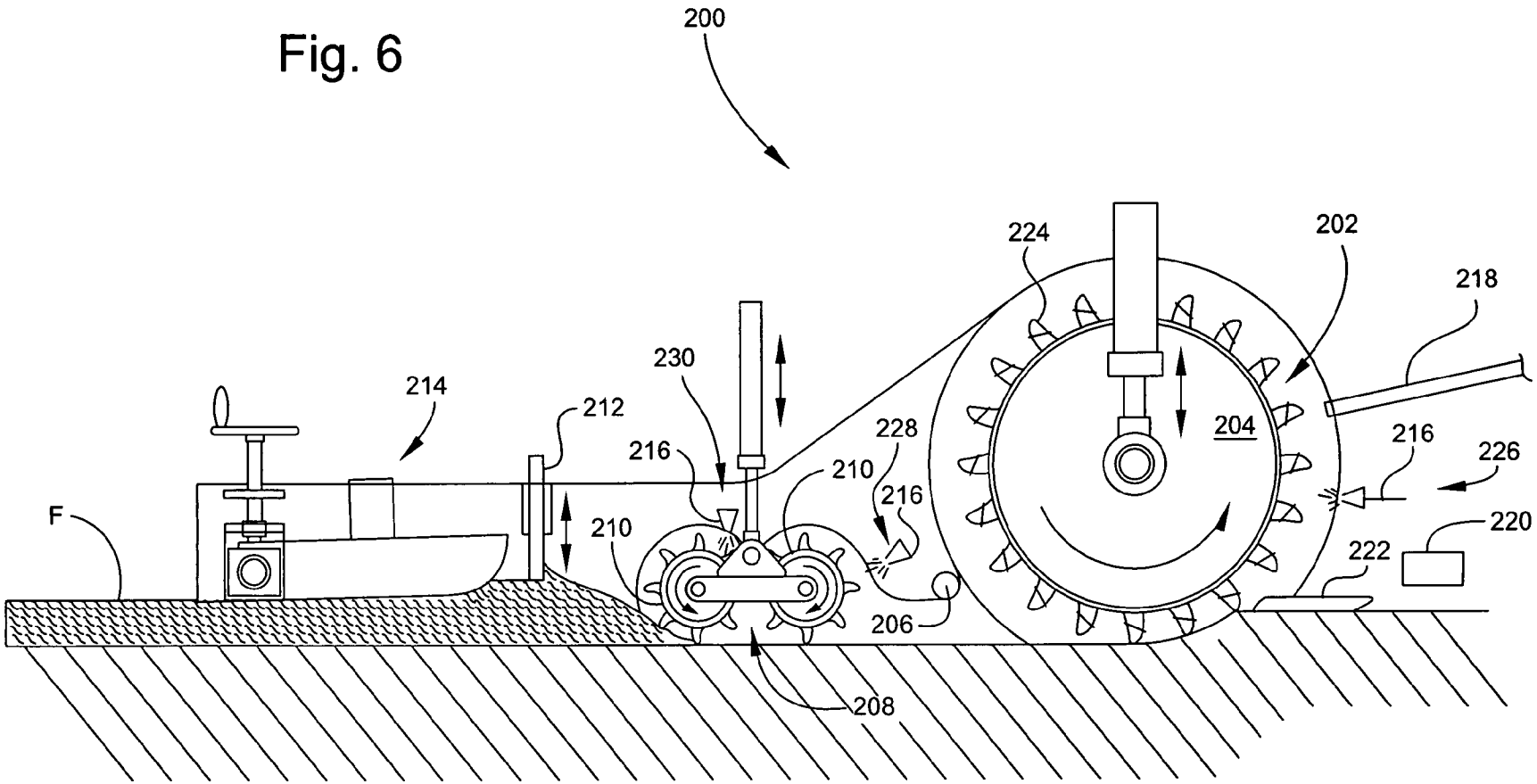
FIG. 6 is a schematic side view of an alternative recycling assembly.

FIG. 6 illustrates schematically an alternative recycling assembly 200. The basic components and operation of the recycling assembly 200 are similar to that of the recycling assembly 24 described above. The recycling assembly includes a grinding chamber 202 containing a rotatable toothed grinding drum 204, a heater 206, a mixing chamber 208 housing a pair of toothed grinding wheels 210, a material control gate 212, an adjustable screed 214, and one or more rows of spray nozzles 216. In this embodiment, a conveyor 218 is arranged to deliver the additional pavement directly to the grinding chamber 202.

The recycling assembly 200 is carried forward over an area of pavement to be patched. If necessary depending upon ambient conditions, the existing pavement is heated with a pre-heater such as a steam box or a propane burner 220 suspended ahead of the recycling assembly 200. The front end of the recycling assembly 200 rides on an anvil 222 thus providing a height reference. The grinder drum 204 is lowered to the appropriate depth and rotated, causing its teeth 224 to break up and grind the old pavement into small pieces. For purposes of illustrative clarity, the flow of old pavement, asphalt binder, and new asphalt from the grinding chamber 202 to the mixing chamber 208 is not shown in FIG. 6. Fluid asphalt may be added by a first row 226 of spray nozzles 216 positioned in the grinding chamber 202. The introduction of fluid asphalt cools and lubricates the grinding teeth 224 and also provides a portion of the asphalt binder needed to bring the mixture of old, ground pavement and new pavement to the required properties for re-application as finished pavement.

The mixture then enters the mixing chamber 208 where it is mixed by the mixing wheels 210. If needed, additional fluid asphalt may be added to the mixture from additional rows 228 and 230 of spray nozzles 216. If required, supplemental pavement (typically new, but recycled material may be used) in the required amount is transported directly to the grinding chamber 202 from a feed hopper (not shown) by the conveyor 218.

The heater 206 is mounted behind the grinder drum 204. The heater 206 may comprise a row of burner nozzles fed by propane or other suitable fuel, provided from heating fuel tanks 28 (see FIG. 1). The number and size of the burner nozzles is selected to provide adequate heat to the material passing through the heater 206 to heat the pavement to the proper working temperature for the mixing and patching operation. As the recycling machine 10 moves forward, the mixture of ground pavement, new pavement, and asphalt binder passes under the heater 206 where it is exposed to the flame from one or more burners.

The material control gate 212 is disposed behind the mixing chamber 208. The material control gate 212 is a generally rectangular barrier. Known means are provided for raising and lowering the material control gate 212 to a desired height. The material control gate 212 controls the volume of material which passes to the downstream screed assembly 214.

As the recycling machine 10 continues to advance, the mixed pavement passes from the material control gate 212 to the screed assembly 214. The screed assembly 214 extrudes the material out at the desired height to form a finished pavement. The finished pavement "F" may then be consolidated by a roller (not shown) in a known fashion.

The foregoing has described a pavement recycling and patching apparatus and a method for recycling pavement. While specific embodiments of the present invention have been described, it will be apparent to those skilled in the art that various modifications thereto can be made without departing from the spirit and scope of the invention. Accordingly, the above description of the preferred embodiment of the invention and the best mode for practicing the invention are provided for the purpose of illustration only and not for the purpose of limitation, the invention being defined by the claims

What is claimed is:

1. A pavement recycling assembly, comprising:

a frame having left and right side plates, a top plate, and an open bottom for contacting a pavement surface, said frame defining a mixing chamber which is open to said pavement surface, and an opening in said top plate in communication with said mixing chamber;

a flat anvil disposed at a forward end of said frame for engaging said pavement surface, wherein said anvil is movable longitudinally relative to said frame;

a laterally-extending toothed grinding drum rotatably mounted in a grinding chamber in said frame behind said anvil and ahead of said mixing chamber for breaking up and grinding said pavement, wherein the vertical position of said grinding drum is adjustable relative to said frame to change the depth of cut of said grinding drum, and wherein said anvil is coupled to said grinding drum such that said anvil moves rearward as said grinding drum is moved upward and said anvil moves forward as said grinding drum is moved downward;

means for rotating said grinding drum;

means for introducing fluid asphalt into said frame;

at least one laterally-extending toothed rotatable mixing wheel having an axis of rotation generally parallel to an axis of rotation of said grinding drum disposed in said mixing chamber for forming a mixture of said fluid asphalt and said ground pavement, said mixing wheel being exposed to said pavement surface;

means for rotating said mixing wheel; and a screed assembly disposed behind said mixing chamber for extruding said mixture at a desired height so as to form a pavement.

2. The pavement recycling assembly of claim 1 wherein said means for introducing fluid asphalt comprises at least one row of spray nozzles.

3. The pavement recycling assembly of claim 2 wherein said row of spray nozzles is disposed above said opening.

4. The pavement recycling assembly of claim 1 wherein first and second laterally-extending toothed rotatable mixing wheels are disposed in said mixing chamber.

5. The pavement recycling assembly of claim 1 further comprising a heater disposed in said frame behind said grinding drum from heating said ground pavement.

6. The pavement recycling assembly of claim 1 further comprising a vertically adjustable material control gate disposed in said frame behind said mixing chamber for controlling the amount of material flowing into said screed assembly.

* * * * *